United States Patent [19]

Hardin

[11] Patent Number: 4,509,426

[45] Date of Patent: Apr. 9, 1985

[54] AUTOREVERSING DUAL AXIAL SPEED INK ROLLER

[76] Inventor: Philip J. Hardin, 850 Park La., Elm Grove, Wis. 53225

[21] Appl. No.: 646,476

[22] Filed: Aug. 31, 1984

Related U.S. Application Data

[63] Continuation-in-part of Ser. No. 544,258, Oct. 21, 1983, abandoned.

[51] Int. Cl.[3] ..... B41F 31/14; B41F 31/26; B41L 27/28

[52] U.S. Cl. ..... 101/348; 101/DIG. 14

[58] Field of Search ..... 101/348, 349, 350, 351, 101/352, 354, 355–358, 360, 361, 205–209

[56] References Cited

U.S. PATENT DOCUMENTS

| | | | |
|---|---|---|---|
| 1,239,127 | 9/1917 | Ramsaier | 101/348 |
| 1,415,480 | 5/1922 | Ramsaier | 101/348 |
| 1,726,559 | 9/1929 | Halpern | 101/DIG. 14 |
| 2,745,343 | 5/1956 | Davis | 101/DIG. 14 |

*Primary Examiner*—J. Reed Fisher

*Attorney, Agent, or Firm*—Fuller, House & Hohenfeldt

[57] ABSTRACT

A cylindrical ink roller sleeve is mounted on a fixed shaft for sliding axially on and rotating on the shaft. First and second helical elements are fixed internally of the sleeve coaxially with each other and concentric to the shaft. The convolutions of the helixes have different pitches and twist in opposite directions. A device having helix followers at opposite ends is supported from the shaft. Rotation of the sleeve while one helix is engaged by a follower drives the sleeve axially in one direction at one speed until a limit is reached whereupon the one follower is disengaged from one helix and the other follower is engaged with the other helix to drive the ink roller sleeve in the opposite direction at a different axial speed.

19 Claims, 10 Drawing Figures

AUTOREVERSING DUAL AXIAL SPEED INK ROLLER

BACKGROUND OF THE INVENTION

This is a continuation-in-part of application Ser. No. 544,258, filed Oct. 21, 1983, now abandoned.

The invention disclosed herein is for obtaining uniform distribution of printers ink on rollers that apply ink to photolithograph image plates such as are used in offset printing presses.

As is well known, an offset printing press has several stages each of which has a lithographic plate for printing one color of several colors that compose the image of an object or a scene. One or more lithographic plates are mounted on a rotatable plate cylinder and, during press operation, the plates are repeatedly recoated with ink. Damp rollers pass over the plate surface followed by inking rollers. Image design areas on the plate which are inherently greasy repel water but retain the ink which is also greasy and the clear areas on the plate retain water and repel ink. The inked image areas on the plates are transferred or offset onto an impression cylinder which has a rubber coated periphery from which the image is transferred to an individual sheet, usually paper, that is passing between the plate cylinder and impression cylinder.

A major problem in offset presses is to get uniform and consistent distribution of the ink film on the image plates. Nonuniformities result in ghosts appearing in the printed impression which are particularly noticeable in large areas that have dense coloration. In an attempt to minimize this problem, prior printing presses have arranged a large number of cylindrical rolls whose peripheries are in tangential contact with each other. At least one of the rollers is in tangential contact over its length with another roller that rotates in an ink bath and gets a heavy coating of ink on it. The next roller pressing against the roller in the ink bath picks up a thinner coating of ink and transfers it to the series of rollers which, in turn, transfer and spread ink from one to another until at the end of the series a thin and, hopefully, uniform coating is applied to the last stage of rollers which are called the form rollers. The form rollers make tangential contact with the image plates on the plate cylinder and, thus, deposit an ink film of one color thereon. As the plate cylinder rotates, it transfers the impression to an impression cylinder for further transfer or printing on the paper sheet.

A prior art practice for improving the uniformity of the coating on the form rollers is to have at least one of the rollers in the series that contacts one or more of the other rollers, oscillate in opposite axial directions to produce a rubbing effect between rollers which augments forming a uniform film or ink. Prior art axially oscillating rollers are driven in one axial direction at the same speed as in the other direction. It has not been recognized heretofore that this approaches but falls short of obtaining ideal ink film uniformity. This is because any point on the axially oscillating roller will trace what is essentially a sinusoidal or wavy line on the cylinder to which it is tangential and the point will be retraced repeatedly substantially within the same annular band around the roller with which the oscillating roller is in tangential contact.

SUMMARY OF THE INVENTION

A primary objective of the present invention is to provide a oscillating roller that brings about more uniform distribution of the ink film on the rollers which it contacts. This object is achieved, in accordance with the invention, by providing an oscillating roller drive mechanism which drives the roller at one speed in one axial direction and at a different speed in the opposite axial direction. A further advantage of this is that ink distribution can be improved to the extent that there is a good prospect for being able to eliminate some of the transfer rollers in the series between the ink reservoir and the final form rollers.

Other objectives are to provide a dual axial speed oscillating roller than has a self-contained oscillating mechanism and that requires minimal power to drive it.

Briefly stated, one embodiment of the new autoreversing dual axial speed ink roller assembly comprises a shaft that is fixed and spans across the width of the press. The axis of this shaft is parallel to the axes of other rollers in the series. A guide block is fixed to this shaft and it carries a rocker arm that rocks about an axis that is orthogonal to the axis of the fixed shaft. There are axially spaced apart plungers or helix followers in the guide block that are movable radially relative to the axis of the shaft. Opposite ends of the rocker arm engage the respective plungers such that as the arm rocks, one of the plungers will be driven radially outwardly and the other will be retracted radially inwardly at any given time. Each plunger has a radially projecting tooth or helix follower prong. A cylinder whose external periphery is highly polished for smoothing ink by contacting an adjacent cylinder or ink transfer roller is supported concentrically with the stationary shaft by circular support members which have bores for accommodating bearings that permit the polished cylinder to rotate and translate axially on the fixed shaft. In the preferred embodiment a tubular drive member is fixed inside of the polished cylinder or outer sleeve so it rotates and moves axially with the sleeve. The bore of the drive member is provided with helical grooves, comparable to female threads. The helical grooves or threads extending in one axial direction away from the pivot point of the rocker arm have a certain pitch and the helical grooves extending in the other direction from said pivot have a different pitch. The follower prong on one plunger at a time registers in a helical groove or helix convolutions while the prong on the other plunger is retracted out of the helical groove with which it cooperates. There are strikers at the outboard ends of each of the differently pitched helixes. When the polished outer sleeve is driven rotationally as a result of being in tangential contact with another driven ink roller, the axially constrained follower prong on one plunger will be engaged with its cooperating thread so the rotating helical groove, being engaged with the prong, will cause the roller to slide on the fixed shaft in one axial direction at a speed that is governed by the rotational speed of the roller and the pitch of the active helical groove. Motion in this direction continues until the active prong reaches the striker at the outer end of the groove or helix convolutions and this causes the rocker arm to pivot and thereby effect registration of the prong on the other plunger in its cooperating helical groove which has the other pitch. The striker at the end of this groove again rocks the rocker arm and reverses the direction of movement of the roller.

Another embodiment of the autoreversing roller also uses a fixed shaft that spans the width of the press. Its axis is parallel to the axes of the other ink distributing rollers. A generally U-shaped bracket is fastened to the fixed shaft and the axially spaced apart arms of the bracket are bored and receive bushings, respectively, in which a rotatable shaft is journaled. There is a follower wheel member, somewhat like a propeller, fastened to the respective ends of the rotatable shaft. Radially extending prongs, like the blades, of one propeller-like follower member are displaced 90° about the rotatable shaft axis relative to the prongs of the other member. The ink roller is a cylinder whose external periphery is highly polished. As in the previous embodiment this cylinder encases a cylindrical drive member having a bore in which there are a pair of coaxial helical grooves which extend in opposite axial directions away from the middle of the drive member and the convolutions of each helix have different pitches and an opposite twist. A prong from one of the follower members extends into one or the other helix grooves at one time. Thus, as the ink roller cylinder turns as a result of its periphery being in tangential contact with another rotating roller, registry of the axially immovable prong in a helical groove that twists in one direction will drive the roller axially through a certain distance. Then the engaged or registered prong strikes a stop element set in the groove near an end of the helix. This rotates the active prong on the one follower member out of engagement with the one helical groove and rotates a prong on the other follower member synchronously into engagement with the helical groove of opposite twist and a different pitch so the roller translates in the reverse direction at a different axial speed. Detent means are provided to hold the follower members in a constant angular position except when they are being forcibly rotated. Damping means are provided to inhibit overtravel and absorb shock when the prongs strike the stop elements that rotate them.

A more detailed description of the new dual axial speed oscillating ink roller will now be set forth in reference to the drawings.

DESCRIPTION OF THE PREFERRED EMBODIMENT

Figure 1:
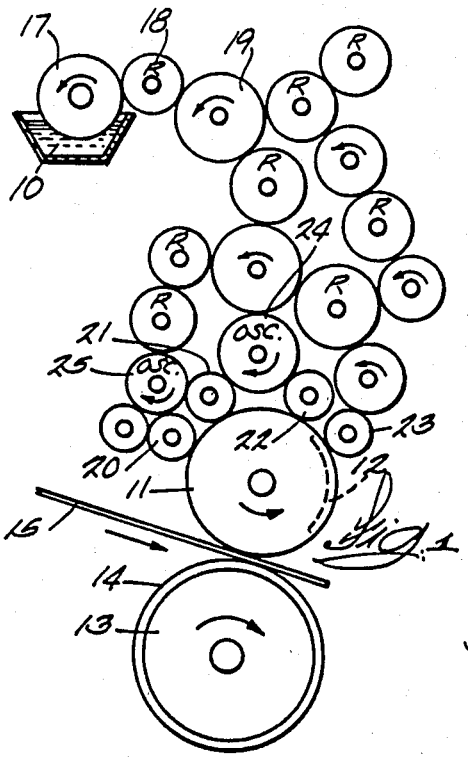
FIG. 1 is a schematic diagram of the ink transfer rollers and the plate cylinder and impression cylinder which comprise an offset printing press and in which one or more of the new dual axial speed oscillating rollers may be used.

FIG. 1 is a diagram showing, among other things, the arrangement of rollers for transferring printers ink from a reservoir 10 to a printing plate cylinder 11 in one stage of an offset printing press. A photolithographic plate that is mounted on cylinder 11 is depicted in dashed lines and marked 13. The object of the invention is to assure that a thin uniform coating of ink is applied to image plate 12. The impression cylinder 13 is contiguous with plate cylinder 11 and has its periphery encased in a rubber sleeve or mat 14 as is typical of offset printing presses. As cylinders 11 and 13 rotate, photolithographic plate 12 periodically makes an impression on the outer surface of mat 14. The impression is then transferred to the bottom of one of the paper sheets 15 that are fed through the press consecutively and constitute the material on which the impression is printed.

In FIG. 1, a plurality of rollers whose peripheries are in tangential contact with each other are used to transfer the viscous and greasy ink from reservoir 10 to the printing plate 12. Rollers that are marked with the letter "R" have rubber coated peripheral surfaces. Rollers that lack the letter have polished metal peripheral surfaces. The first roller in the series is the ink pickup roller 17 which, as a result of rotating in ink, becomes heavily coated with printers ink. Most of the ink is squeezed off by the first rubber coated roller 18 which is then coated with a film of ink. A thin coating of ink is, of course, deposited on metal surface roller 19. The ink then transfers through a devious path from roller to roller and finally ink coats the surfaces of the four form rollers 20, 21, 22 and 23 which cooperate to apply a coat of ink to photolithographic plate 12. Two of the ink dispersing rollers in the sequence, those marked 24 and 25, are marked OSC to indicate that they not only rotate but also oscillate axially to produce a rubbing action on the rollers with which they make tangential contact and thereby augment uniform spreading of the ink on the rollers. Axially oscillating rollers 24 and 25 are exemplary and in accordance with the invention are driven at two different axial speeds by the new drive mechanism which will be described in detail shortly hereinafter.

The number of arrangement of the ink spreading rollers in FIG. 1 is intended to be illustrative. The manner in which the rollers are arranged differs between different press manufacturers. If one or two oscillating rollers of the type which move in axially opposite directions at different axial speeds as hereinafter described are used, it is expected that the number of other rollers may be reduced while still being able to obtain the good ink distribution that has been obtained by substituting the new dual axial speed rollers for the prior art single axial speed rollers.

Figure 2:
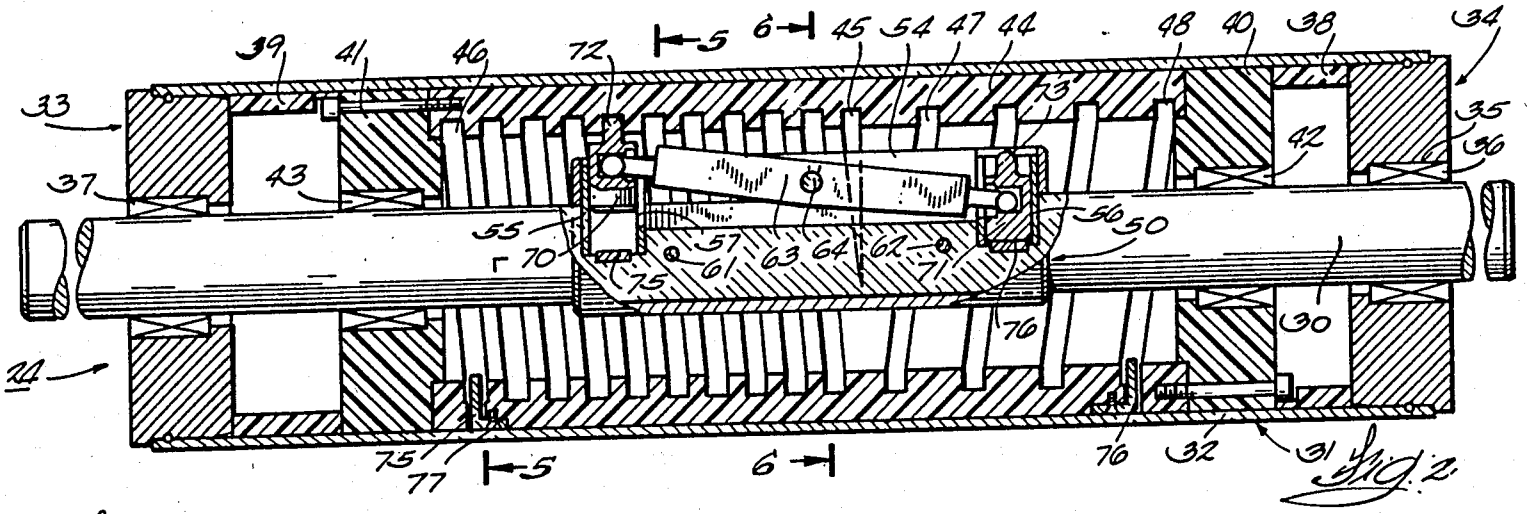
FIG. 2 is a vertical section of the new oscillating ink roller.

The improved roller and its self-contained oscillating mechanism will now be described in greater detail in reference to FIGS. 2–6. Refer first to FIG. 2. The roller assembly comprises a stationary shaft 30 which is substantially coextensive in length with the shafts that support the other rollers. Shaft 30 spans substantially across the width of the press and is clamped at both ends by means that are not shown. The roller assembly includes an outer sleeve 31 whose outer peripheral surface 32 is highly polished metal such as steel. Opposite ends of the outer sleeve 32 fit on circular end caps 33 and 34. Typical end cap 34 at the right end of the roller has a central bore 35 which, in the preferred embodiment, has a needle-type bearing 36 fitted into the bore. This type of bearing permits outer sleeve 32 to rotate on shaft 30 and to translate along the shaft in one axial direction or another. End cap 33 at the left is provided with a similar needle-type bearing 37. Inside of the outer sleeve 31 and next to the end caps 33 and 34 there are spacer members or inner sleeves marked 38 and 39, respectively. These spacers are preferably made of plastic to minimize the weight and inertia of the roller assembly. Within the outer sleeve 31 there are also another pair of caps or circular support members 40 and 41. These support members also have needle bearings 42 and 43 for permitting rotary and axial movement. Circular support members 40 and 41 are preferably made of a synthetic resin such as nylon but they could be made of other materials. End caps 33 and 34 are preferably made of metal.

A cylindrical drive member 44 is fitted snugly inside of the bore of outer sleeve 31. The drive member 44 has sets of internal threads of helical grooves whose convolutions twist in opposite directions. The inboard end of one helical groove is marked 45 and the outboard end of the same groove is marked 46. The inboard end of the other helical groove or thread is marked 47 and its outboard end is marked 48. The pitch between the helical convolutions or grooves 47 to 48, as can be seen, is greater than the pitch between the convolutions 45 to 46. Typically, the pitch of the convolutions in one helix should be about twice that of the other. The grooves define oppositely twisted helical guide paths. The cylindrical drive member, is, in a preferred embodiment, comprised of nylon having molybdenum sulfide filler to enhance the lubricating property of nylon which in itself develops low friction where it interfaces with moving metal parts. Drive member 44 may also be made of other materials that have a low coefficient of friction. A resin such as nylon containing graphite could, for example, also be used for the drive member. It will be evident that the outer ink spreading sleeve 31 and drive member 44 will rotate together since the drive member is clamped in the outer sleeve 31 and is captured between end caps 40 and 41 by use of several machine screws such as the one marked 48.

Figure 3:
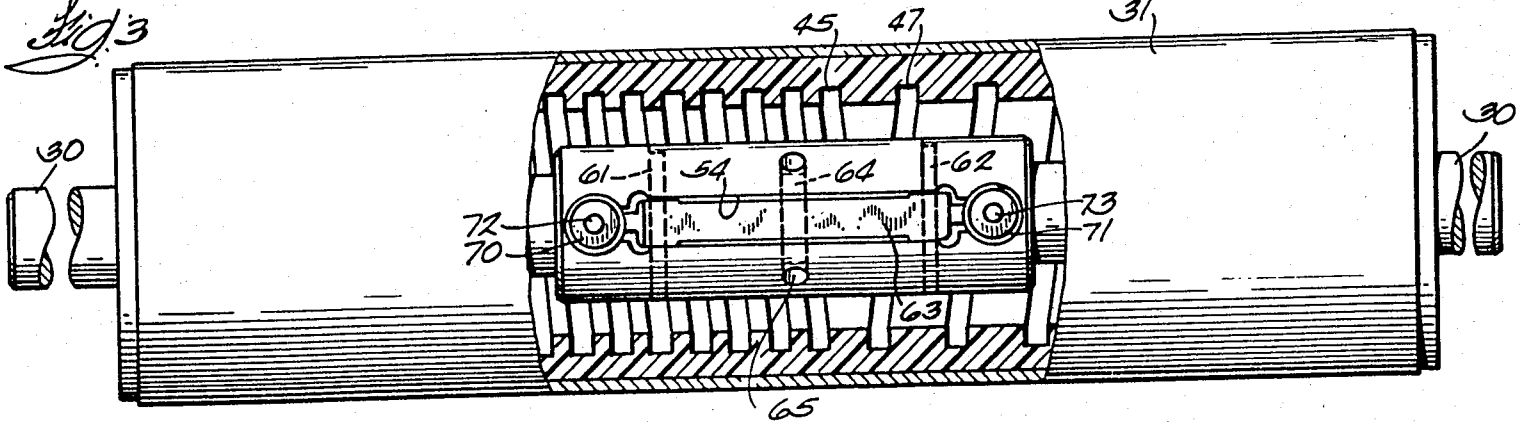
FIG. 3 is a view of the roller assembly in FIG. 2 with the top of the outer sleeve broken away to exhibit a plan view of some of the internal parts of the roller.

Referring to FIGS. 2 and 3, a guide block assembly 50 is clamped to stationary shaft 30. As can be seen particularly well in FIG. 4, the guide block 50 assembly comprises a cylindrical body 51 which has an eccentric axial bore 52 for fitting it on shaft 30. The eccentric axial bore permits a thick wall 53 to be defined on one side of the cylindrical body 51. There is an axially extending slot or recess 4 in the top of cylindrical body 51. At opposite ends of the slot there are round radially extending bores which are lined with bearing sleeves 55 and 56 that have slots 57 and 58 in their sides. Guide body 51 is secured to shaft 30 by means of cross pins which fit through the holes 59 and 60 shown in FIG. 4. The pin fitting through hole 59 is marked 61 in FIGS. 2 and 6 and the pin that fits through hole 60 in the body is marked 62 in FIG. 2. Of course, both pins 61 and 62 go through and fit tightly in holes in stationary shaft 30.

Figure 4:
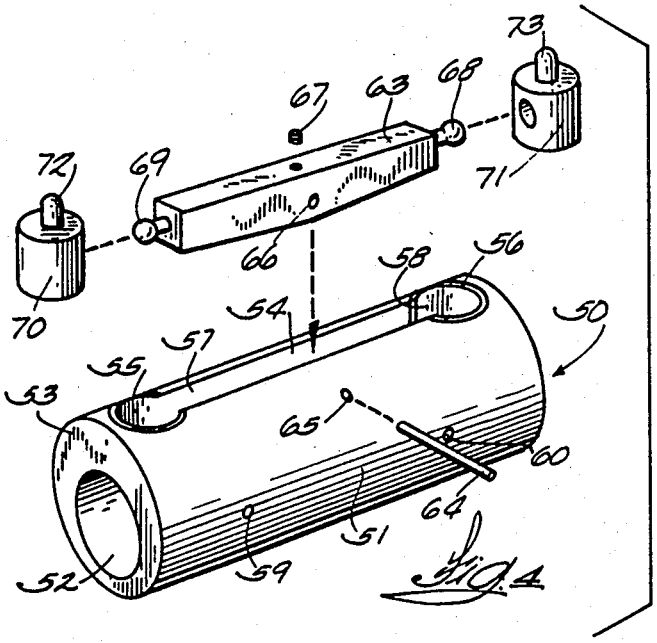
FIG. 4 is an exploded view of the guide block, the rocker arm and plungers which it carries, these parts being isolated from the FIG. 2 assembly.

As shown in FIG. 4, a rocker arm 63 fits into slot 54 in guide member 51. Rocker arm 63 rocks or pivots on a pin 64 that passes through a hole 65 in the guide body 51 and also passes through a hole 66 in the rocker arm. A set screw 67 fastens the rocker arm to pin 64 and the latter rotates in hole 65 which acts as a bearing.

As shown in FIG. 4, rocker arm 63 has extension rods which terminate in spherical elements 68 and 69. The spherical elements are for coupling the rocker arm 63 to a pair of radially movable plungers 70 and 71 which have follower prongs 72 and 73 extending radially from them. As can be seen in FIG. 2, when rocker arm 63 is rocked or pivoted to its clockwise limit, prong 72 of plunger 70 is registered or engaged in a helix whose grooves or convolutions have the lesser pitch. When rocker arm 63 is rocked by means which will be described, so its reaches its counterclockwise limit, prong 72 will be withdrawn from the smaller pitch helix and follower prong 73 on the other plunger 71 will register in a helix whose grooves or convolutions have the greater pitch. Thus, rocker arm 63 basically pivots on fixed shaft 30 about an axis that is orthogonal to shaft 30. The rocker arm functions as a follower interlock means.

To assure that when rocker arm 63 is tilted to either limit of its rotation so as to register one plunger prong 72 in its cooperating helical groove and retract the other plunger prong 73 from its cooperating helical groove, or vice versa, small magnets 75 and 76 are set in shaft 30 at the bottom of the guide sleeves 55 and 56 for the follower plungers 70 and 71 to be attracted by the magnets so as to remain bottomed in their guide sleeves after they are forced to this condition by means that will now be described.

Figure 5:
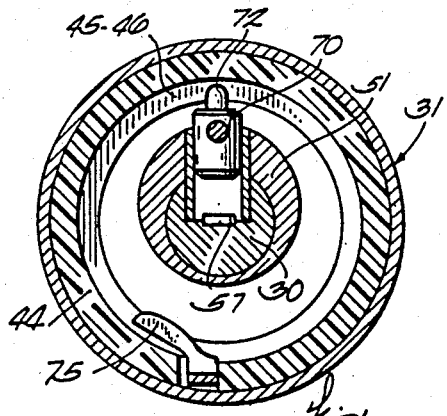
FIG. 5 is a transverse section through the roller taken on a line corresponding with the irregular line 5—5 in FIG. 2.
Figure 6:
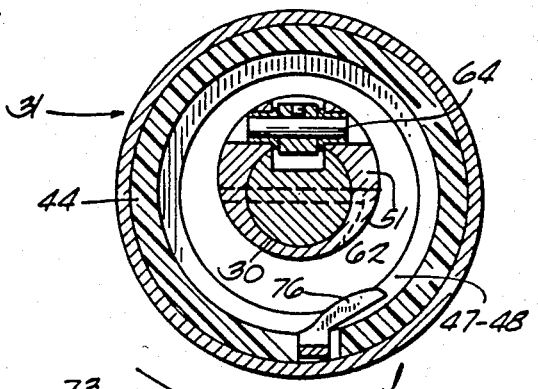
FIG. 6 is a transverse section through the roller assembly taken on a line corresponding with 6—6 in FIG. 2.

The following plungers are actuated and the rocker arm 63 is tilted by having the prongs on the plungers encounter tripping elements or cam-like strikers 75 and 76 which are shown in FIG. 2 and FIGS. 5 and 6, also. As shown in FIG. 2, typical striker 75 is generally L-shaped in cross section and fits through a slot in the wall of the internally grooved drive member 44. Striker 75 is anchored by means of a screw 77. Assume now that outer sleeve 31 and internally helically grooved drive member 44 are rotating together and that, considering FIG. 2, follower prong 72 is engaged with its cooperating helical groove extending from inboard convolution 45 to outboard convolution 46. In such case the outer roller sleeve 32 and everything attached to it would be driven axially to the right along shaft 30 at a speed depending on the pitch of the helical groove and the rotational speed of the roller. Thus, the helical groove acts like a lead screw turning on a fixed follower prong. When the roller has made a sufficient number of turns and advanced to what is intended to be its limit in one axial direction, the follower prong 72 will be in the last convolution 46 of the helix in which case it will encounter striker 75 that will cause rocker arm 63 to be rocked counterclockwise as viewed in FIG. 2. This will drive left plunger 70 radially inwardly and disengage its follower prong 72 from its cooperating helical groove 45–46. Concurrently, the follower prong 73 on the right plunger 71 will be driven into registry with its cooperating helical groove 47–48 in drive member 44. Then, as rotation of the sleeve 31 continues, it will be driven axially in the reverse direction at a different axial speed than before. Finally, prong 73 on plunger 71 will encounter its cooperating striker 76 which will tilt the rocker arm 63 so that driving the roller in the opposite axial direction can repeat. The axial oscillations at different speeds in opposite directions while the outer sleeve continues to rotate in the same direction optimizes spreading the ink uniformly on the roller that is in tangential contact with the roller sleeve 31 and which drives the latter rotationally.

FIGS. 5 and 6 show how the strikers 75 and 76 are angulated and curved so they drive the plungers down smoothly. Very little force is required to overcome the magnetic attraction of the plungers to initiate rocking of the rocker arm and, furthermore, the rocker arm is well balanced which contributes towards minimizing the amount of force that is necessary to rock it.

In an actual embodiment, pairs of additional slots, not shown, are provided in the driver member 44 for accommodating an alternative pair of strikers which are 180° out of phase with the strikers that are shown. The alternate pair of strikers are employed when the roller sleeve 31 is driven in a direction rotationally opposite that of the illustrated embodiment.

As shown in FIG. 1, the oscillating rollers that were just described are driven rotationally by tangential and frictional contact with adjacent power driven ink spreading rollers. An important feature of the dual axial speed oscillating roller just described in connection with FIGS. 2–6 is that it requires trivial power to rotate it. Only a small tangential force needs to be applied by an adjacent roller to the polished periphery 32 of the outer sleeve 31 for driving the sleeve rotationally and also providing sufficient force for driving the roller sleeve axially. This is so because there is minimal friction between the prongs 72 and 73 and the surfaces of the helical grooves which are composed of low friction material as has been previously mentioned. Use of the needle bearings 36, 37, 42 and 43 also minimizes rotational and axial friction between the sleeve assembly and the stationary shaft.

The concept of having differently pitched helixes run on alternately reciprocating followers can be implemented by using elements similar to two oppositely wound coil springs, not shown, having different pitches arranged end to end an fastened interiorly of the outer roller sleeve 31. The coils can be made of a low friction material. In such case, the followers on the plungers can be grooves rather than prongs so the grooves can engage the sides of the turns of the coils.

Figure 7:
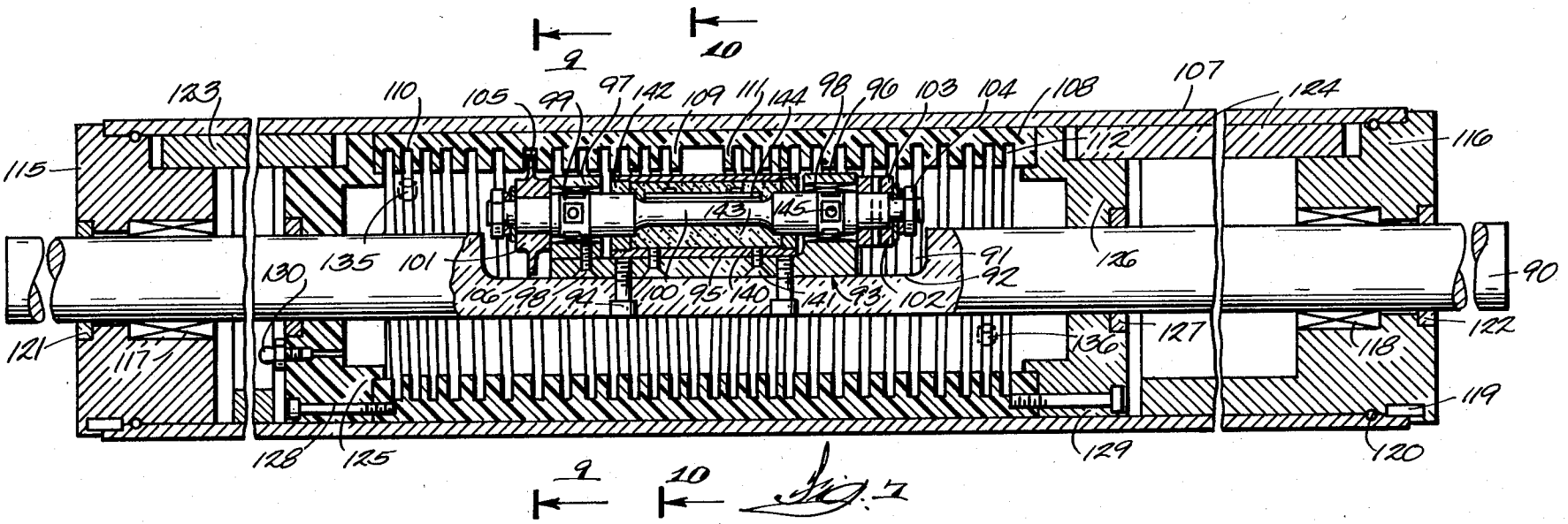
FIG. 7 is a longitudinal vertical section of an alternative embodiment of the oscillating ink roller.

An alternate embodiment of the autoreversing ink roller will now be described in reference to FIGS. 7–10. In FIG. 7, the shaft which spans across the press and is clamped to the press, is marked 90. The center of the shaft has a recess 91 that has a flat bottom 92. A bracket 93 is fastened in recess 91 by means of screws such as the one marked 94. The bracket is generally U-shaped and comprised of a base portion 95, an upstanding arm 96 that is integral with the base portion and another arm 97 which is fastened to the base portion by means of screws 98. The upstanding arms 96 and 97 are provided with bushings 98 and 99. A shaft 100 is journaled in the bushings. Follower wheel members 101 and 102 are secured on opposite ends of shaft 100 by means of through pins such as the one marked 103 and nuts such as the one marked 104. Follower wheel members each have a pair of diametrically opposite radially extending prongs. For example, member 101 has followers or prongs 105 and 106 and member 102 has prongs 107 and 108. The prongs 107 and 108 on member 102 are 90° out of phase with the prongs 105 and 106 on member 101.

The roller in FIG. 7 has an outer cylindrical sleeve 107 which has a highly polished outside surface on which a film of ink is spread. A cylindrical drive member 108, which is comparable to drive member 44 in the previously described embodiment, has sets of internal threads or helical grooves whose convolutions twist in opposite directions away from the center of the member. The inboard end of one helical groove is marked 109 and the outboard end of the same groove is marked 110. The inboard end of the other helical groove is marked 111 and its outboard end is marked 112. The pitch between the helical convolutions or grooves 109 to 110 is different than the pitch between the helical convolutions 111 to 112.

Figure 8:
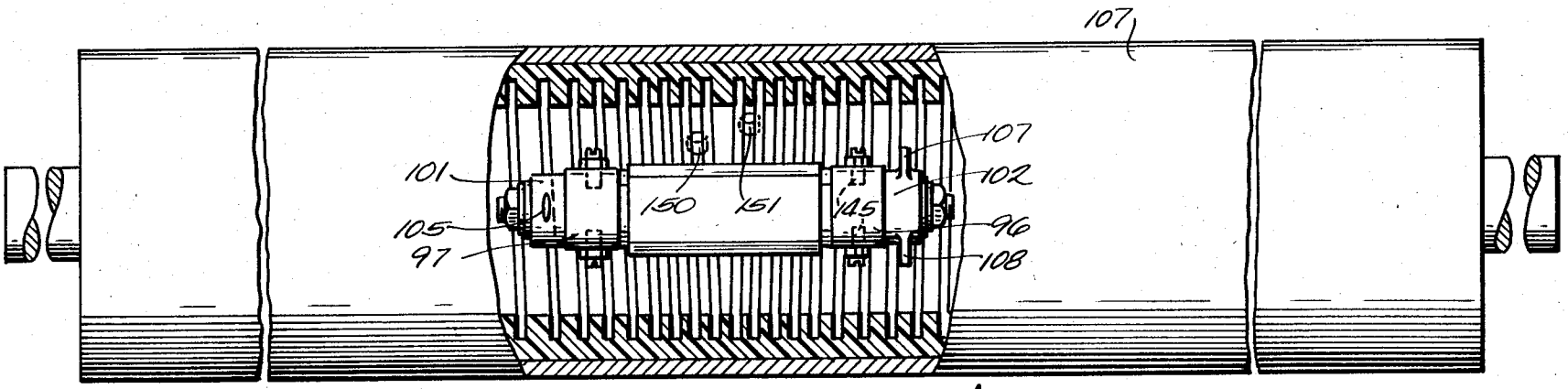
FIG. 8 is a plan view of the roller with a central portion broken away.

As can be seen in FIGS. 7 and 8 particularly well, a prong of one of the follower wheels 101 or 102 is engaged in one or the other differently pitched and oppositely twisted helical grooves at one time. The internally grooved drive member 108 is nonrotatable in outer sleeve 107 so that when the sleeve is rotated, the drive member rotates. The outer sleeve is fitted with caps 115 and 116 at its opposite ends. The end caps are bored for receiving roller bearings 117 and 118. Thus, the roller, including outer sleeve 107 and inner drive member 108 can rotate relative to stationary shaft 90 and can slide in opposite axial directions on shaft 90. The end caps are prevented from rotating relative to outer sleeve 107 with dowel pins such as the one marked 119. O-ring seals such as the one marked 120 prevent ink from entering the interior of the assembly and prevent lubricant from leaking out. There are additional seals 121 and 122 between the caps 115 and 116 and stationary shaft 90. Inner sleeves 123 and 124 are provided. They are axially adjacent a pair of cap members 125 and 126 also provided with seals such as the one marked 127 that bear on stationary shaft 90. Cap members 125 and 126 are secured to the internally grooved drive member 108 by means of machine screws 128 and 129. Cap 125 is provided with a fitting 130 for injecting lubricant to the interior of the assembly.

Figure 9:
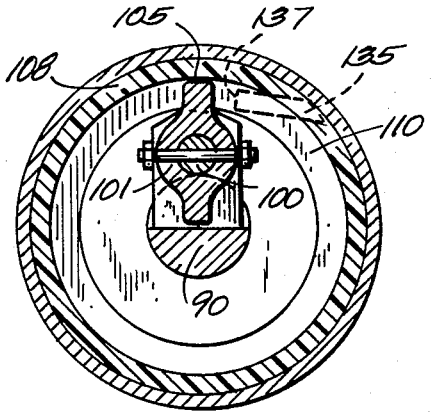
FIG. 9 is a transverse vertical section taken on line 9—9 in FIG. 7.

It will be evident from inspection of FIG. 7 that when outer sleeve 107, that is, the ink roller itself is rotated about the axis of stationary shaft 90 with a prong such as the one marked 105 engaged or registered in a helical groove, turning drive member 108 and outer sleeve 107 will translate axially in one direction along shaft 90 since the action is similar to a nut turning on a thread of a bolt. The limit of axial travel of the roller assembly on shaft 90 is determined by the location of one of two pairs of stop or blocking members which are actually pins marked 135 and 136. A typical stop pin 135 is shown in FIG. 9. This pin is inserted through a hole drilled substantially along a chordal line through internally grooved drive member 108. The tip 137 extends into the helical groove marked 110 and provides a surface which can abut a prong 105, for example. Thus, when the orbiting stop pin 135 advances to alignment with follower member prong 105 the follower member 101 will rotate with shaft 100. Upon this event the prong will be disengaged from the helical groove running from 109 to 111 and a prong from the other follower member 102 will rotate into engagement or registry with the starting end of the groove running from 111 to 112. Thus, because the grooves or convolutions of the driver are on opposite sides of the midline of the assembly and are like right and left hand threads, the driver will turn on the prong and move the ink roller in the opposite axial direction until the now engaged prong abuts striker pin 136. Then the follower members will turn jointly again through an angle of 90° and the axial direction of the roller will reverse. The pairs of helical grooves are not only oppositely twisted but they also have different pitches so that the ink roller will translate axially faster in one direction than in the other direction. The pitches at the inboard ends of each set of grooves and at their outboard ends may be closer to each other than th pitch of the grooves in between the ends so that the roller will accelerate and decelerate more slowly immediately after and before translational direction is changed. This reduces the shock that might occur if direction were changed abruptly.

Figure 10:
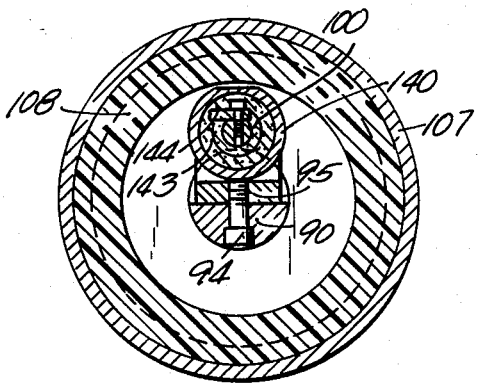
FIG. 10 is a transverse vertical section taken on line 10—10 in FIG. 6.

Referring again to FIG. 7, one may see that the shaft 100, on which the follower wheels 101 and 102 are mounted has its central region surrounded by a cylindrical element 140 which is fastened to the base 95 of bracket member 93 by means of screws 141. There are seals 142 between the cylinder 140 and shaft 100. Cylinder 140 and seals 142 define a chamber 143 which is filled with a viscous material such as grease. There is a paddle 144 mounted to shaft 100. As can be seen in FIG. 10, the paddle 144 will plow through the grease 143 to thereby dampen or offer a slight resistance to rotation of shaft 100. This further stabilizes and smooths rotation of shaft 100 when a follower prong is impacted by a stop pin that rotates the follower.

As shown in FIG. 7, shaft 100 is provided with hemispherical detent recesses 145. There are four such recesses, spaced 90° apart at each end of shaft 100. FIG. 8 shows how these recesses are aligned, respectively, with threaded studs 146. These studs screw through the upstanding parts of the bracket that supports shaft 43 and through clearance holes in the bearings 96 and 97. There is a spring and a ball bearing, not shown, at the inward tip of each stud. The ball sets in one of the recesses 145 for each right angular position of the shaft 100 so as to act as a detent for holding shaft 100 and the follower members in a fixed position after they have been indexed 90° and start experiencing any minor frictional drag that might occur as a result of the walls of the helical grooves rubbing against the prongs.

It was pointed out earlier that stop pins 135 and 136 were involved in tripping the follower wheels at the ends of axial travel of the roller to effect reversing it. These pins are in use when the sleeve 107 is being driven in one rotational direction. As can be seen in FIG. 8, there is another pair of stop pins 150 and 151 set in the helical grooves for acting on the follower wheel prongs for the other rotational direction of roller outer sleeve 107. In such case, stop pin 150 would cooperate with the prongs on follower member 101 and stop pin 151 would cooperate with the prongs on follower member 102.

Although a preferred embodiment of the dual axial speed oscillating ink distribution roller has been described in detail, such description is intended to be illustrative rather than limiting, for the inventive concepts may be variously implemented and are to be limited only by interpretation of the claims which follow.

I claim:

1. An ink roller adapted for oscillating in opposite axial directions, comprising:

a stationary shaft, support means slidable in opposite axial directions on and rotatable on said shaft, a cylindrical roller sleeve supported by said support means concentric to said shaft for being driven rotationally and for moving axially on said shaft, means defining first and second coaxial and axially adjacent helixes in said sleeve concentric to said shaft and rotatable with said sleeve, the twist of the convolutions of one helix being opposite of the twist of the other, first and second movable follower members arranged in axially spaced apart relationship along said shaft inside of said helixes for cooperating with said first and second helixes, respectively, and means for moving the first follower member into engagement with the first helix and disengaging the second follower member from the second helix and alternately moving the second follower member into engagement with the second helix and disengaging the first follower member from the helix whereby when the first rotating helix is engaged, it will turn on said first follower member and drive said sleeve in one axial direction and when the second rotating helix is engaged, it will turn on said second follower member and drive said sleeve in the other axial direction.

2. The ink roller according to claim 1 wherein the pitch of the convolutions of one helix is different than the pitch of the convolutions of the other helix so that said sleeve is driven in opposite axial directions at different speeds.

3. The ink roller according to any one of claims 1 or 2 wherein said movable follower members are each mounted for being moved radially outwardly and inwardly conversely of each other for engaging and disengaging, respectively, with one and the other of said helixes.

4. The ink roller according to any one of claims 1 or 2 werein said movable follower members are each mounted for moving rotationally together and said members have prongs extending radially away from the rotational axis of said members, the prongs on one member being angularly displaced about said rotational axis from the prongs on the other so a prong on one member will rotate into engagement with one helix concurrently with a prong on the other member rotating out of engagement with the other helix.

5. An axially oscillating ink distributing roller assembly adapted for being driven rotationally by tangential contact with another rotationally driven roller, said assembly comprising:

a stationary shaft, support means journaled on said shaft for sliding in opposite directions and for rotating on said shaft, a cylindrical roller sleeve for being contacted by said driven roller and supported by said support means concentrically to said shaft, means defining first and second coaxial and axially adjacent helixes interiorly of said sleeve and concentric to said shaft, the pitch between convolutions of one helix differing from the pitch of the other and the twist of the convolutions in one helix being opposite of the twist of the other, a member mounted to said shaft inside of said helixes and radially movable first and second plunger means mounted in axially spaced apart relationship in said member, each of said plunger means having follower means for engaging alternately with said helixes for the helixes to turn on said follower means, respectively, to thereby move said roller sleeve in opposite axial directions at different speeds, and means responding to either helix driving said sleeve to a predetermined limit in either direction by forcing one plunger and its follower means out of driving engagement with the other helix.

6. An ink roller adapted for oscillating in opposite axial directions at different speeds, comprising:

a stationary shaft, support means slidable in opposite axial directions on and rotatable on said shaft, an outer cylindrical roller sleeve for being driven rotationally by another tangentially contacting rotating roller, said sleeve supported by said support means concentric to said shaft, a drive member having an axial bore concentric with and interior of said sleeve, said bore having first and second oppositely twisted helical grooves arranged axially adjacent each other, the pitch of the convolutions of the first and second helical grooves differing from each other, an axially extending rocker arm supported from said shaft and pivotable about an axis orthogonal to the axis of the shaft, said arm having a first helix groove follower element on one side of said axis and a second helix groove follower element on the other side for said first and second elements to alternately register in and retract from the respective corresponding helical grooves coordinately with rocking of said arm, whereby when the first element is registered in the first helical groove said grooved will turn on said element and move said outer sleeve axially at one speed in one direction and when said second element is registered in the second helical groove said groove will turn on said second element and move the outer sleeve in the opposite axial direction at a different speed, and means for rocking said arm when said sleeve has moved a predetermined distance in one axial direction so as to retract one follower element from its cooperating helical groove and register the other in its cooperating helical groove for driving the sleeve in the opposite axial direction.

7. The ink roller according to claim 6 wherein said means for rocking said arm includes at least one striker element located in each helical groove axially remote from the other for striking the follower elements alternately to rock said arm and retract one follower element from one cooperating helical groove and engage the other element with the other helical groove to thereby limit axial movement of said roller in both axial directions.

8. The ink roller according to claim 6 including a guide member fastened to said shaft, said rocker arm pivoting on said guide member, said follower members comprising ferromagnetic plungers pivotally connected to opposite ends of said arm and guided for moving generally radially in said member, said plungers having radially projecting prongs for engaging in said grooves, and a magnet fixed in said guide member radially inwardly of each plunger remotely from the prong for retaining one plunger retracted from one helical groove while the prong of the other plunger is engaging the other helical groove.

9. The roller according to any one of claims 6, 7 or 8 wherein said drive member is composed of a plastic material containing a solid lubricant.

10. The roller according to any of claim 6, 7 8 wherein said drive member is comprised of nylon.

11. The roller according to any of claims 6, 7 or 8 wherein said drive member is composed of nylon containing molybdenum sulfide.

12. The roller according to any of claims 6, 7 or 8 wherein said drive member is composed of nylon containing graphite.

13. An ink roller adapted for oscillating in opposite axial directions, comprising:

a stationary shaft, support means slidable in opposite axial directions on and rotatable on said shaft, a cylindrical roller sleeve supported by said support means concentric to said shaft for being driven rotationally and for sliding axially on said shaft, means defining first and second coaxial and axially adjacent separate helical grooves inside of said sleeve concentric to said shaft and rotatable with said sleeve, the twist of the convolutions of one groove differing from the twist of the other, a support member mounted to said stationary shaft between opposite ends of said sleeve and shaft means journaled for rotation in said support member about an axis parallel to the axis of the stationary shaft, and follower members extending radially from said rotatable shaft means at axially spaced apart locations on said rotatable shaft means inside of the helical grooves, respectively, a follower member at one location being angularly displaced about the axis of the rotatable shaft means relative to a follower member at the other location such that the member at one location can be rotated into engagement with one helical groove while a member at the other location is rotated out of engagement with the other helical groove, means for rotating a follower member at one location into engagement with one helical groove and a follower member at the other location out of engagement with the other helical groove and alternately rotating the member at the one location out of engagement with the one helical groove and the member at the other location into engagement with said other helical groove, such that when the one helical groove and its cooperating follower member are engaged said groove turns on the member and drives said outer sleeve in one axial direction and when the other helical groove and its cooperating follower member are engaged said other groove turns on said follower member and drives said sleeve in the other axial direction.

14. The ink roller according to claim 13 wherein said follower members each are comprised of diametrically opposite radially extending pairs of prongs that engage in said grooves for driving said sleeve and the prongs in one pair are angularly displaced by 90° about the axis of said rotatable shaft means relative to the other pair.

15. The ink roller according to any one of claims 13 or 14 wherein said means for rotating said radially extending follower members are stop elements fixed in said grooves at locations where when said sleeve has moved axially to a desired limit in one direction, said stop elements due to rotating with said helical grooves will strike a radially extending follower member and rotate it to disengage it from its cooperating helical groove and engage another member with its cooperating helical groove.

16. The ink roller according to claim 13 including:

a hollow stationary chamber surrounding said rotatable follower shaft means for containing a viscous material, and paddle means fixed to said shaft means for rotating through said viscous material.

17. An axially oscillating ink distributing roller assembly adapted for being driven rotationally by tangential contact with another rotationally driven roller, said assembly comprising:

a stationary shaft, support means journaled on said shaft for sliding in opposite directions and for rotating on said shaft, a cylindrical ink roller sleeve for being contacted by said driven roller and supported by said support means concentrically to said shaft, means defining first and second coaxial and axially adjacent helical grooves interiorly of said sleeve and concentric to said shaft, the convolutions of said grooves being oppositely twisted, support means mounted on said stationary shaft, axially spaced apart bearings mounted in said support means and a rotatable shaft journaled in said bearings in parallelism with said stationary shaft, first and second follower members fastened in axially spaced apart relationship on said rotatable shaft for cooperating, respectively, with said first and second helical grooves, each follower member having a pair of radially extending diametrically opposite prong elements, the prong element pair on one follower element being disposed orthogonally about the shaft axis relative to the prong element pair on the other member so that one prong element on one follower member at a time will be engaged inits cooperating groove, rotation of said roller sleeve causing corresponding rotation of said helical grooves such that the groove that is engaged by a prong element will turn on said element and drive said roller sleeve in one axial direction, striker means fixed in each of said grooves for determining the travel limits of said sleeve in both axial directions, rotation of said helical grooves causing the striker means to reach the prong of the one follower member that is engaged in the one groove and impact the prong to thereby disengage said prong and rotate said shaft for effecting engagement of a prong of the other follower member to drive said sleeve axially in the opposite axial direction.

18. The roller assembly according to claim 17 including:

a chamber mounted to said stationary shaft and surrounding said rotatable follower member carrying shaft in sealing relationship and a viscous material in said chamber, and paddle means on said shaft within said chamber.

19. The roller assembly according to claim 17 including detent means wherein said rotatable shaft is provided with four concave recesses in its periphery arranged equiangularly about the axis of the shaft, four screw means mounted in said support and aligned with the recesses, respectively, a ball and a spring for pressing the ball toward the shaft interposed between each screw means and the shaft, the start of rotation of said shaft by the force of said striker means causing said balls to depart from said recesses and rotation of said shaft up to 90° causing said balls to reset in said recesses to thereby inhibit rotation of said shaft and the follower members thereon due to any frictional force between said grooves and said prongs.

* * * * *

UNITED STATES PATENT AND TRADEMARK OFFICE

CERTIFICATE OF CORRECTION

PATENT NO. : 4,509,426

DATED : April 9, 1985

INVENTOR(S) : Philip Hardin

It is certified that error appears in the above-identified patent and that said Letters Patent are hereby corrected as shown below:

Claim 10, Column 11, line 64 delete "claim 6, 7 8" and substitute ---claims 6, 7 or 8---.

Claim 17, Column 13, line 32 delete "inits" and substitute ---in its---.

Signed and Sealed this

*Eighth* Day of *October 1985*

[SEAL]

*Attest:*

*Attesting Officer*

DONALD J. QUIGG

*Commissioner of Patents and Trademarks—Designate*